US005514831A

United States Patent [19]

Imamura

[11] Patent Number: 5,514,831

[45] Date of Patent: May 7, 1996

[54] ENVELOPE WAVEFORM PRODUCING CIRCUIT OF A SMALL SCALE CIRCUIT CONSTRUCTION FOR USE WITH REPRODUCING MUSICAL NOTES

[75] Inventor: Miyuki Imamura, Tokyo, Japan

[73] Assignee: Seikosha Co., Ltd., Tokyo, Japan

[21] Appl. No.: 227,804

[22] Filed: Apr. 14, 1994

[30] Foreign Application Priority Data

Apr. 16, 1993 [JP] Japan ..... 5-90001

[51] Int. Cl.$^6$ ..... G10H 1/057

[52] U.S. Cl. ..... 84/627

[58] Field of Search ..... 84/627, 663, 702, 84/703, 738

[56] References Cited

U.S. PATENT DOCUMENTS

| | | |
|---|---|---|
| 4,426,904 | 1/1984 | Ishibashi . |
| 4,961,364 | 10/1990 | Tsutsumi et al. . |
| 5,033,352 | 7/1991 | Kellogg et al. . |
| 5,256,831 | 10/1993 | Kozuki et al. . |

FOREIGN PATENT DOCUMENTS 2081955 7/1981 United Kingdom .

*Primary Examiner*—Stanley J. Witkowski
*Attorney, Agent, or Firm*—Jordan and Hamburg

[57] ABSTRACT

An envelope waveform producing circuit includes a ROM for storing a plurality of groups of parameter data, each group of parameter data defining a waveform of an envelope which includes data representing at least one of an attack rate and an attack level and data representing at least one of a decay rate and a sustain level, an address designator, connected with the ROM, for reading out a desired group of parameter data from the ROM to cause an envelope waveform to be produced in accordance with the parameter data read out, an UP/DOWN counter for selectively counting up and down from a preset value, a coincidence detector, connected with the UP/DOWN counter, for detecting coincidence between a counted value of the UP/DOWN counter and a predetermined value, a control circuit, connected with the UP/DOWN counter and the address designator, for controlling the address designator to read out desired parameter data and for controlling the UP/DOWN counter to count up or down from the preset value, and activation or deactivation of the UP/DOWN counter.

16 Claims, 10 Drawing Sheets

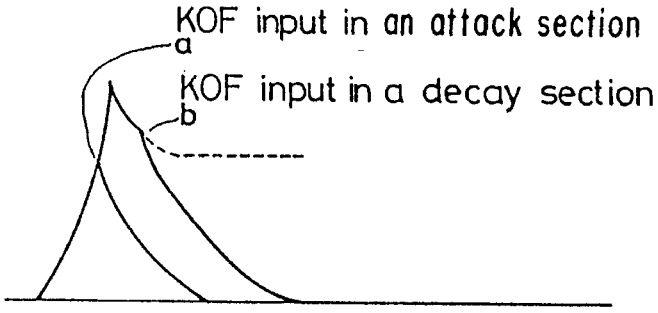
FIG. 5
FIG. 6(a)
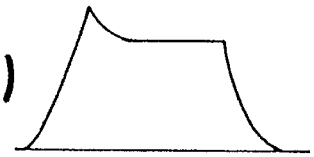
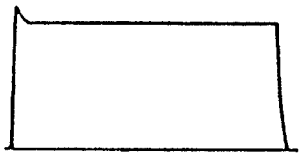
FIG. 6(b)
FIG. 6(c)
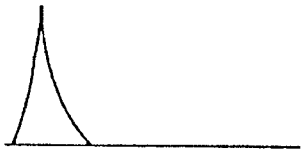
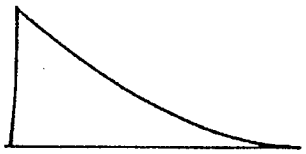
FIG. 6(d)
FIG. 6(e)
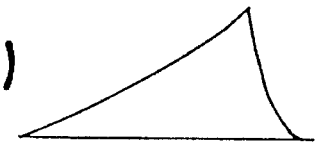
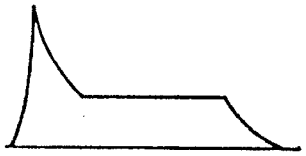
FIG. 6(f)

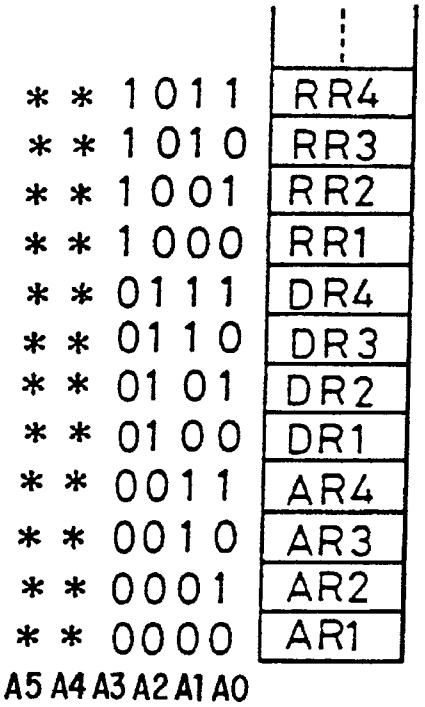
FIG. 10(b)
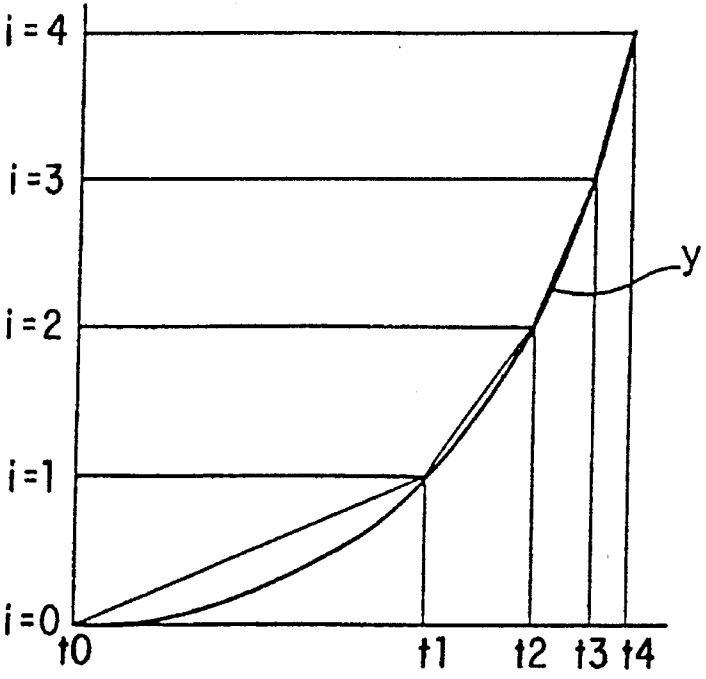
FIG. 10(a)
$$N = \frac{\phi}{2^{n-m}} \cdot \frac{1}{k} \log \frac{2^{n-m} \cdot (i+1)+1}{2^{n-m} \cdot i+1}$$
FIG. 10(c)

ENVELOPE WAVEFORM PRODUCING CIRCUIT OF A SMALL SCALE CIRCUIT CONSTRUCTION FOR USE WITH REPRODUCING MUSICAL NOTES

FIELD OF THE INVENTION

The present invention relates to an envelope waveform producing circuit.

BACKGROUND OF THE INVENTION

In a known electronic musical instrument, a melody reproduction apparatus, or the like which is designed to generate musical tones, an envelope waveform is applied to the waveform data read out from a waveform ROM having particular musical-tone waveforms stored therein, to generate a musical tone. Examples of such an envelope waveform application circuit include one in which CR discharge characteristics are utilized, one which is equipped with a ROM stored therein with PCM data for an envelope waveform, and the like.

The first-mentioned envelope waveform application circuit, as shown in FIG. 12(*a*), comprises a transistor Tr, a capacitor C, and a resistor R. A pulse shown in FIG. 12(*a*) by 12*a*A is applied to a gate of the transistor Tr to open the transistor Tr. The capacitor C is thereby electrically charged, and the electric charge thus obtained is discharged via the resistor R. Through this charging and discharging operation, an envelope waveform shown in FIG. 12(*a*) by 12*a*B is obtained. This envelope waveform 12*a*B constitutes an envelope of the output signal from a D/A converter 12*a*2 for providing D/A conversion of the waveform data 12*a*C read out from a waveform ROM 12*a*1.

The second-mentioned envelope waveform application circuit includes an envelope ROM 12*b*1 having stored therein, in the form of PCM data, the envelope waveform shown in FIG. 12(*b*) by 12*b*A, for example, which includes sound-volume level data varying with time. The sound-volume level data is read out from that envelope ROM 12*b*1 and is multiplied by the waveform data 12*b*B read out from a waveform ROM 12*b*2, in a multiplication circuit 12*b*3. The resulting product is subjected to D/A conversion by a D/A converter 12*b*4 to obtain a musical tone.

However, in the first-mentioned envelope waveform application circuit only a simple envelope waveform can be obtained, posing the problem that it is not easy to modify the waveform. Further, as the number of musical tones to be simultaneously generated increases, the respective number of transistors, capacitors and resistors also increases, which poses a problem that the density of the circuit is increased and the cost is also increased.

Further, the second-mentioned envelope waveform application circuit is required to have a large storage capacity (several K bits to several tens of K bits) and therefore is difficult to integrate.

SUMMARY OF THE INVENTION

The object of the present invention is to easily obtain various envelope waveforms with a small scale of circuit construction.

The above object can be achieved by an envelope waveform producing circuit comprising a storage means for storing therein a plurality of groups of parameter data, each group of parameter data defining the waveform of an envelope including data representing at least an attack rate or an attack level and data representing at least a decay rate or a sustain level, and an address designation means for reading out a desired group of parameter data from the storage means, thereby causing an envelope waveform to be produced in accordance with the parameter data read out.

BRIEF DESCRIPTION OF THE DRAWINGS

FIG. 1(*b*) is a logic-circuit diagram showing the construction of an envelope waveform producing apparatus according to an embodiment of the present invention;

FIG. 5 is a waveform diagram for explaining the operation of the envelope waveform producing apparatus of FIG. 1;

FIGS. 6(*a*)–6(*f*) are waveform diagrams for explaining the operation of the envelope waveform producing apparatus of FIG. 1;

FIGS. 10(*a*)–10(*c*) are views for explaining the operation of the envelope waveform producing apparatus of FIG. 9;

DESCRIPTION OF THE PREFERRED EMBODIMENTS

An envelope-waveform producing circuit according to an embodiment of the present invention will now be described.

First, the overall envelope-waveform producing circuit according to this embodiment will be described. This circuit is used in, for example, a melody reproduction apparatus shown in FIG. 1(*a*). This melody reproduction apparatus is constructed so as to designate a desired tune melody from a melody ROM which stores therein the melody data (music data comprised of steps, note-indicated tone length, etc.) corresponding to a plurality of tunes, and reproduces the melody of the desired tune. The apparatus comprises an oscillation circuit 1a1 for generating a reference clock signal $\phi$, a melody ROM 1*a*2 storing therein the melody data corresponding to a plurality of tunes, a step frequency-divider circuit 1*a*3 for frequency-dividing the reference clock pulse signal $\phi$ according to the step data of the melody data, a waveform ROM 1*a*4 for storing therein the waveform of musical tones, an envelope waveform producing circuit 1*a*5 of this embodiment for producing an envelope waveform, a multiplication circuit 1*a*6 for multiplying the musical-tone waveform by the envelope waveform, a D/A converter 1a7 for D-A converting an output of the multiplication circuit, an amplifier 1a8 and a speaker 1a9 for reproducing an output of the D/A converter as a musical tone, a timing pulse signal generation circuit 1a10 for generating an operation-timing signal, and a performance control circuit 1a11 for controlling the above-mentioned circuits.

Figure 2A:
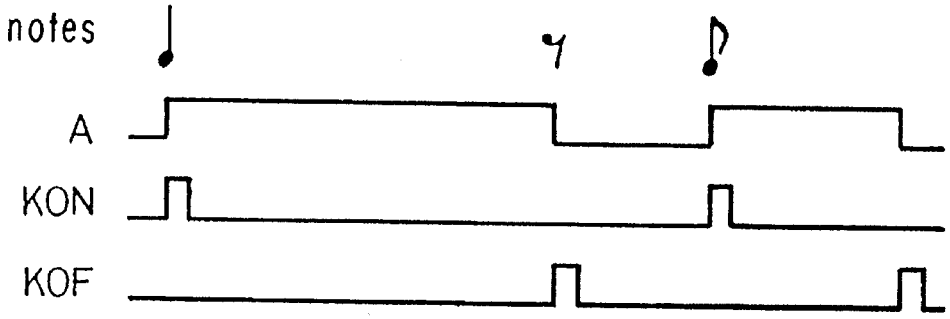
FIGS. 2(*a*) and 2 (*b*) are waveform diagrams for explaining the operation of the envelope waveform producing apparatus of FIG. 1.
Figure 2B:
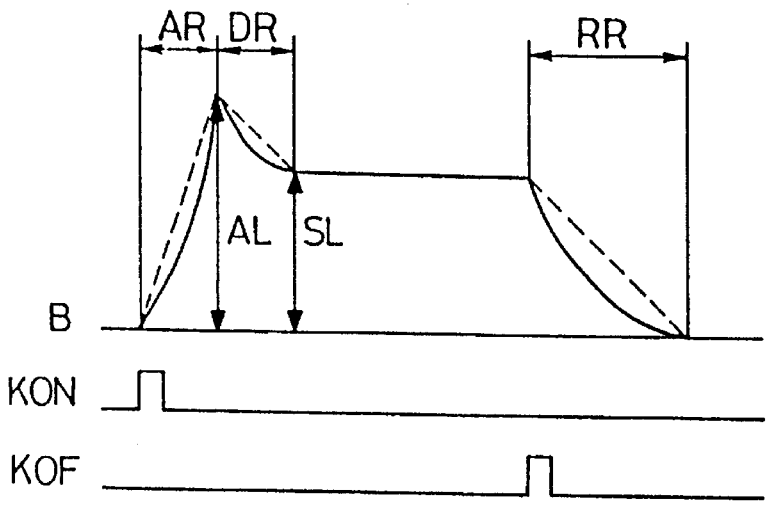

In this melody reproduction apparatus, a tune number is first designated with a tune designation switch connected to the performance control circuit 1a11. Then, when a start switch ST is turned ON, a melody corresponding to the above-designated tune number is sequentially read out from among the melodies stored in the melody ROM 1a2. As shown in FIG. 2a, a keying-on pulse KON and a keying-off pulse KOF are sequentially generated from the timing pulse signal generation circuit in corresponding relation to the note tone length data A. The keying-on pulse KON and the keying-off pulse KOF are sequentially inputted into the envelope-waveform producing circuit 1a5, whereby an envelope waveform B shown in FIG. 2b is produced. In this Figure, the alphabetical notation AR, AL, DR, SL, and RR represent an attack rate (rise time), an attack level (rise level), a decay rate (fall time lasting from the termination of the rise level to the beginning of a sustain level), the sustain level (maintenance level), and a release rate (fall time lasting from the receipt of the keying-off pulse KOF to "0" level), respectively. As described later, the envelope waveform producing circuit 1a5 has a parameter ROM storing therein the parameters defining the above-mentioned attack rate, attack level, decay rate, sustain level, and release rate. Upon receipt of the keying-off pulse KON or the keying-off pulse KOF, those parameters are sequentially read out, whereby an envelope waveform is produced. The waveform ROM 1a4 has one cycle of PCM waveform data stored therein, which is cyclically read out upon receipt of a step clock pulse signal generated from the step frequency-divider circuit 1a3. This waveform data is multiplied by the above-mentioned envelope wave-form data in the multiplication circuit 1a6, thereby obtaining a product. This product is sequentially subjected to D-A conversion in the D/A converter 1a7, and is reproduced as a musical tone from the speaker 1a9 via the amplifier 1a8. The above represents the description of the envelope waveform producing circuit according to this embodiment.

The construction of the envelope waveform producing circuit according to one embodiment will now be described.

Figure 1A:
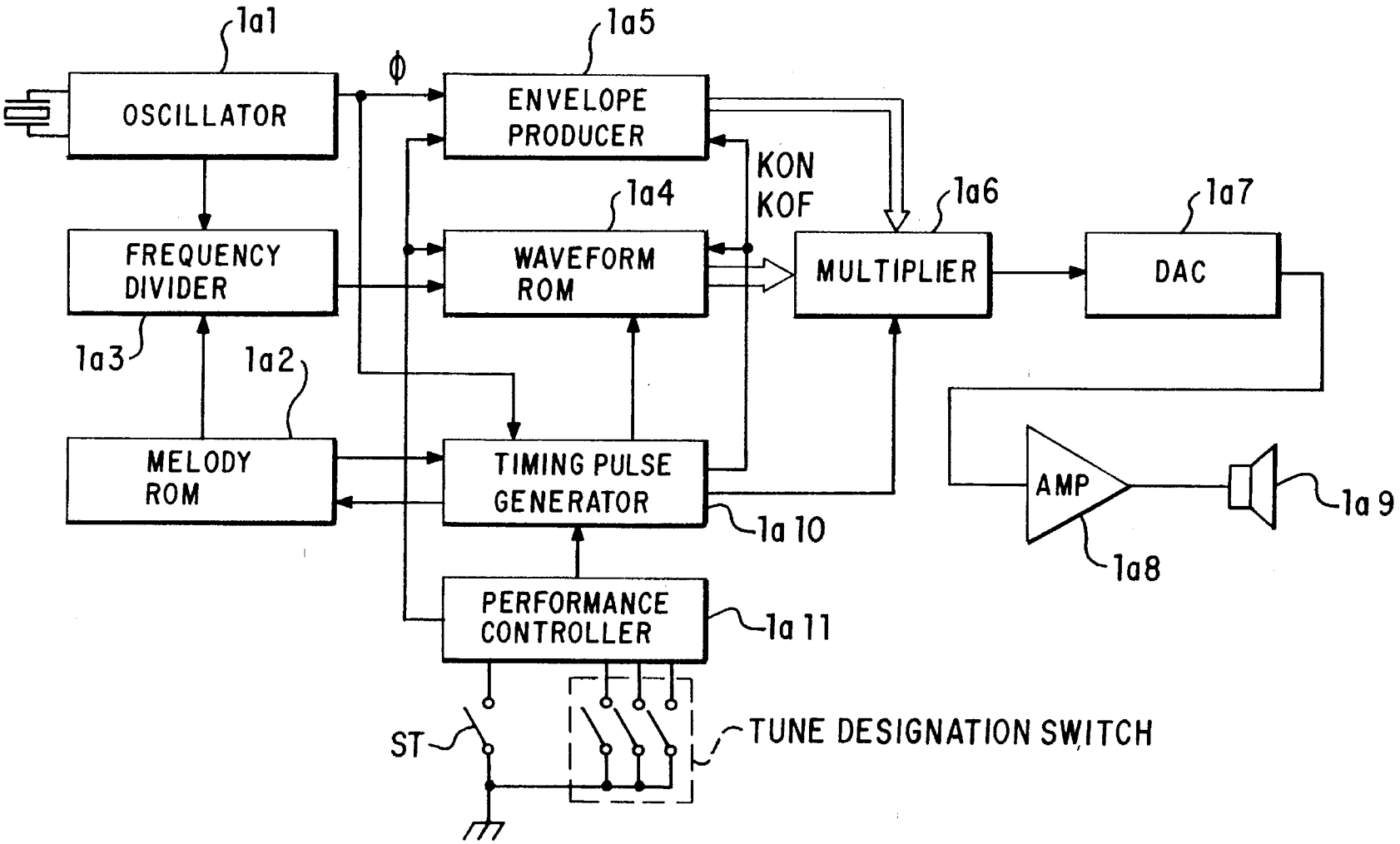
FIG. 1(*a*) is a block diagram of a melody reproduction apparatus with which the present invention is used.
Figure 1B:
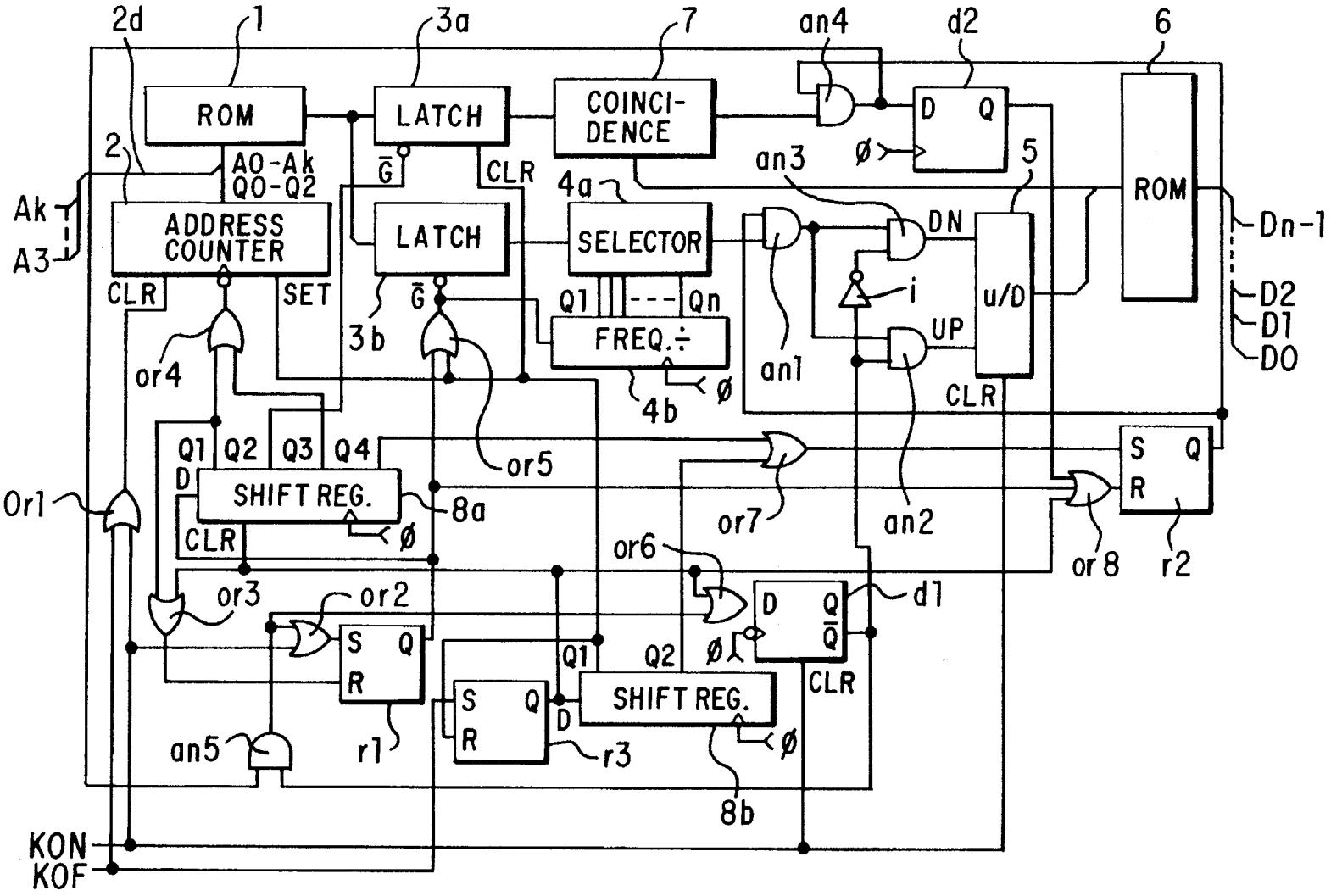
Figure 3:
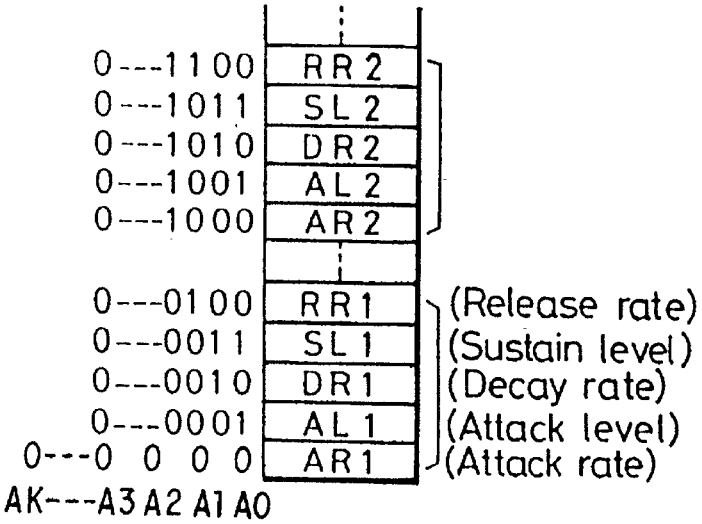
FIG. 3 is a diagram for explaining an essential portion of FIG. 1.

FIG. 1(*b*) is a block diagram showing the construction of the present envelope waveform producing circuit. As shown, the envelope waveform producing circuit includes a parameter ROM 1 serving as a storage means, the parameter ROM storing therein the parameters for defining the attack rate AR, attack level AL, decay rate DR, sustain level SL, and release rate RR shown in FIG. 2(*b*). In parameter ROM 1, as shown in FIG. 3, the parameters are arranged in a plurality of groups, starting from a first group at a lower order address and ascending the latter, each group defining the attack rate AR, attack level AL, decay rate DR, sustain level SL, and release rate RR. The attack rate AR, attack level AL, decay rate DR, sustain level SL, and release rate RR are discriminated by the lower three bits of the address (A0 to A2 shown in FIG. 3) while, on the other hand, the individual groups are discriminated by the upper bits (A3 to Ak shown in FIG. 3). For example, in the address 0 - - - 0000, there is stored the parameter data AR1 for defining a first group of attack rate AR. Similarly, in the addresses 0 - - - 0001 to 0 - - - 0100, there are stored the parameter data AL1 to RR1 for defining the attack level AL to release rate RR of the first group, respectively. Further, when the number of bits corresponding to each parameter data ARm to RRm (m is an integer not less than 1 and indicates the mth group) is assumed to be n bits, one group of parameter data consists of 5 n bits. For example, when n =6, one type of envelope waveform is defined by using thirty bits.

The envelope waveform producing circuit further includes an address counter 2 serving as an address designation means, which address counter is a three bit binary counter. The output terminals Q0 to Q2 thereof correspond to the lower three bits (A0 to A2 shown in FIG. 3), respectively, of one address in any group of parameter data stored in parameter ROM 1, thereby designating one of the parameter data AR to RR in a desired group. Note here that the designation of the upper order bits (A3 to Ak shown in FIG. 3) for designating such a desired group is performed by a signal input into a terminal 2d from the outside, that is, from the above-mentioned performance control circuit or the like.

The envelope waveform producing circuit further includes latch circuits 3a and 3b. Latch circuit 3a time-divisionally latches the parameter data AL and SL by time sharing. Similarly, latch circuit 3b divisionally latches the parameter data AR, DR, and RR by time sharing.

A selector 4a and a frequency divider circuit 4b are provided in the envelope waveform producing circuit. Frequency divider circuit 4b frequency-divides the reference clock pulse signal $\phi$ generated from the oscillation circuit 1a1 in a plurality of frequency-dividing stages (e.g., the number n of bits corresponding to each parameter data). The selector 4a which receives the output of the frequency divider circuit 4b in each frequency-dividing stage (terminals Q1 to Qn shown in FIG. 1(*b*)) thereby, selects a number-of-frequency-division signal from the frequency divider circuit 4b in accordance with the parameter data AR, DR, and RR latched in the latch circuit 3b, and generates a selected number-of-frequency-division signal as a clock pulse signal.

For example, if the value of each parameter data AR, DR, or RR is large, the selected clock pulse signal also has a high frequency. By this clock pulse signal, the rise or fall rate is determined. Further, this clock pulse signal is outputted, via an AND gate an1, to one terminal of each AND gate an2 and an3, the output signals from which are supplied to terminals UP and DN of an U/D (up/down) counter 5, respectively, as later described. It should be noted that mutually inverted output signals from an inverter i are supplied to the other terminals of AND gates an2 and an3 such that only one of the AND gates an2 and an3 is opened.

The enveloped waveform producing circuit further includes U/D (up/down) counter 5 which counts up or down each of the clock pulse signals inputted to the terminals UP and DN. The number of bits in this U/D counter 5 corresponds to the above-mentioned number n of bits. Further, there is provided a data conversion ROM 6 which converts the variation value of the counted value of the U/D counter 5 to an exponential variation value. When it is assumed that the number of bits in U/D counter 5 is n, the address thereof has a numerical value of 0 to $2^n-1$. Thus, data conversion ROM 6 is so set that the numerical value stored in an address (L+i) (L=0 to $2^n-1$) may become substantially $e^K$ (K is a constant which is suitably determined) times as large as the numerical value stored in an address L. The peak value of the envelope waveform is designated by an output data from data conversion ROM 6.

A coincidence detection circuit 7 generates a coincidence signal when the value of the parameter data AL or SL latched in latch circuit 3*a* coincides with the counted value of U/D counter 5. By this coincidence signal, the counting operation thereof is stopped, as later described.

Further, there are provided a 4-stage shift register 8*a* and a 2-stage shift register 8*b*, each of which receives the above-mentioned reference clock pulse signal $\phi$.

Next, the operation of the envelope waveform producing circuit according to this embodiment will be described with reference to FIG. 1(*b*) and FIG. 4, which shows a timing chart for explaining the operation. In the following relevant description, it is assumed that the value of the upper-order bits A3 to Ak of the parameter ROM address for designating a desired group in parameter ROM 1 are designated as 0 - - - 0 and the first group of parameter data are designated.

Figure 4A:
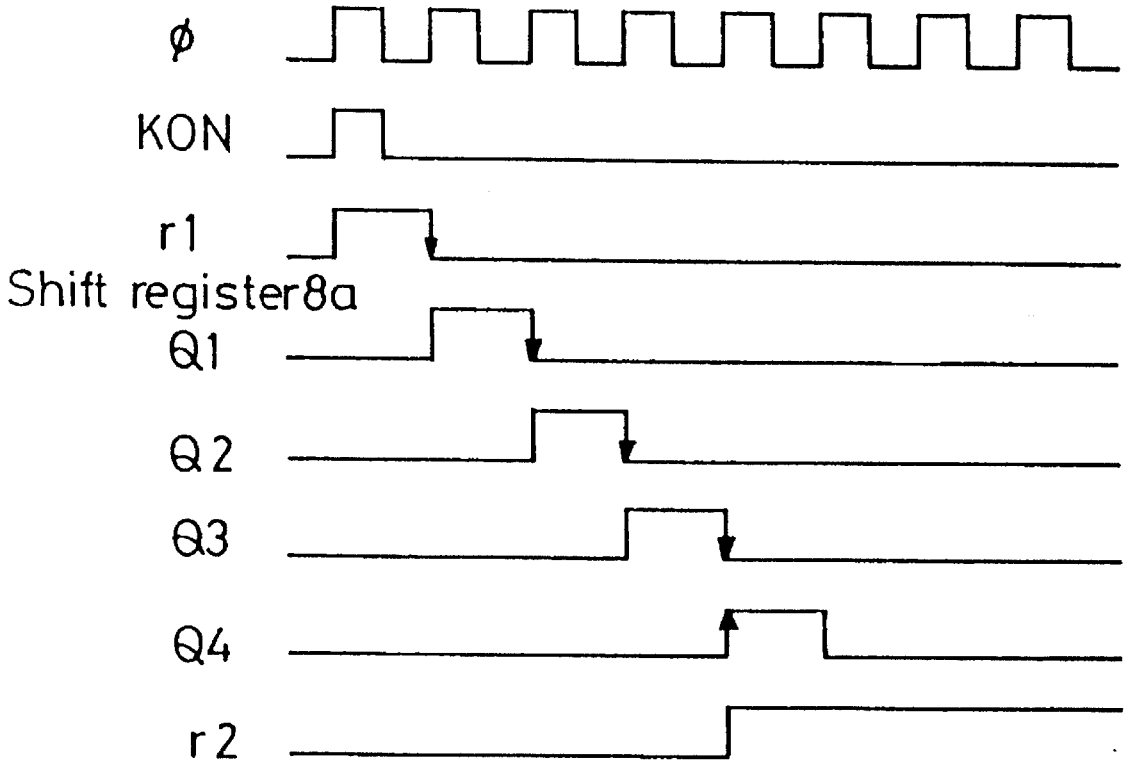
FIGS. 4(*a*) and 4(*b*) are timing charts for explaining the operation of the envelope waveform producing apparatus of FIG. 1.
Figure 4B:
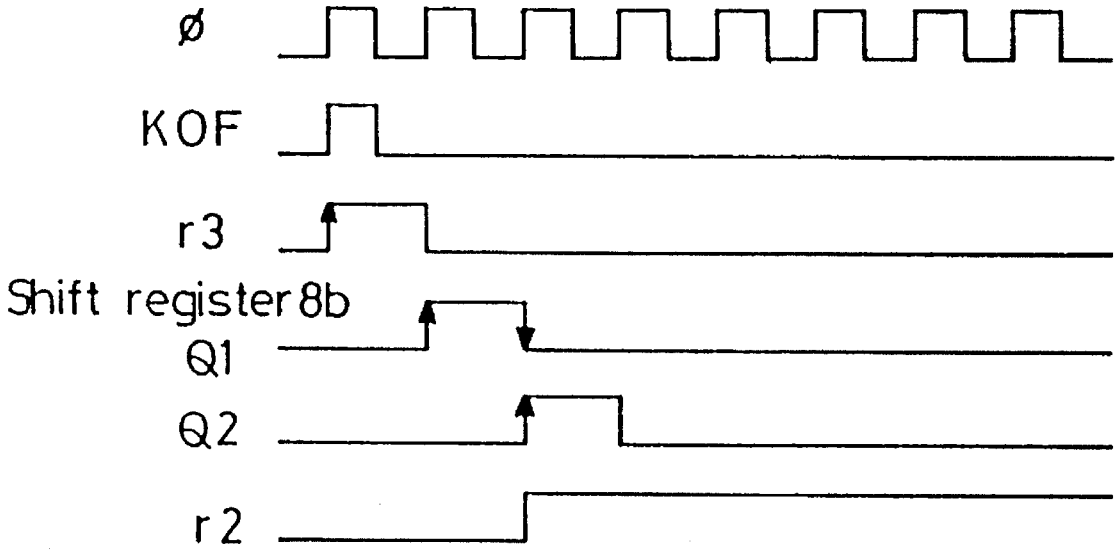

As shown in FIG. 4(*a*), when the keying-on pulse signal KON is inputted into the terminal KON, the respective contents of the U/D counter 5 and a D flip-flop circuit d1 are cleared, and the contents of the address counter 2 are cleared via an OR gate or1. Thus, the parameter data AR1 is read out from the parameter ROM 1. Further, an RS flip-flop circuit r1 is set via a gate or2. The output signal from a terminal Q of the RS flip-flop circuit r1 is supplied to a data input terminal D of the shift register 8*a* to cause a signal at a terminal Q1 thereof to rise. Upon receipt of this signal, the RS flip-flop circuit r1 is reset, so that the output signal of this circuit at the terminal Q thereof is inverted. As this output signal at the terminal Q falls, the parameter data AR1 is latched in the latch circuit 3*b*, the selector 4*a* selects an output signal among the plurality of output signals from the frequency divider circuit 4*b* that indicates a number of frequency divisions corresponding to the contents (here in this context, the parameter data AR1) latched in the latch circuit 3*a*, thus outputting that output signal as a clock pulse signal. This clock pulse signal is outputted into the AND gate an1. At this time, however, the AND gate an1 is closed and outputs no signal.

Subsequently, as the signal of the shift register 8*a* at the terminal Q1 thereof falls, the output signal of the address counter 2 has a value of "001", so that the parameter data AL1 is read out from the parameter ROM 1. As the signal of the shift register 8*a* at the terminal Q2 thereof falls, the parameter data AL1 is latched in the latch circuit 3*a*. The contents of the latch circuit 3*a* are outputted into the coincidence circuit 7.

As the signal of the shift register 8*a* at a terminal Q3 thereof falls, the output signal of the address counter 2 has a value of "010", so that the parameter data DR1 is read out from the parameter ROM 1. Further, as the signal of the shift register 8*a* at a terminal Q4 thereof rises, an RS flip-flop circuit r2 is set to generate an output signal of "1", thereby causing the AND gate an1 to be opened. Further, as the D flip-flop circuit d1 is cleared as mentioned above, the AND gate an2 is opened and the AND gate an3 is closed. Thus, the U/D counter 5 is designated to perform a counting-up operation. Therefore, the clock pulse signal supplied through the AND gate an1 is inputted into the terminal UP of the U/D counter 5 via the AND gate an2. Thus, the U/D counter 5 starts its counting-up of the clock pulse signals. The counted value which is outputted from the U/D counter 5 designates a particular address of the data conversion ROM 6 to cause a corresponding numerical value data therein to be read out. This numerical value data is outputted from an output terminal D0 to Dn-1 as a peak value of the envelope waveform. Thus, the linear increase in the counted value is converted into an exponential increase. Resultantly, the envelope waveform producing circuit according to this embodiment produces a waveform covering an attack section of the envelope waveform B shown in FIG. 2(*b*). The attack section is the section in FIG. 2(*b*) indicated by the attack rate AR. Similarly, a decay section and a release section as later described are sections indicated by the decay rate DR and the release rate RR, respectively, while, on the other hand, a sustain section is a section between the decay section and the release section. Note that the rise in the waveform is determined by the speed of increase in the counted value, i.e., the frequency of the clock pulse signal determined in accordance with the parameter data AR1.

As described above, the waveform outputted from the envelope waveform producing circuit according to this embodiment is supplied to the multiplication circuit 1*a*6, in which that waveform is applied, as an envelope waveform, to the waveform data outputted from the waveform ROM 1*a*4.

Further, the counted value outputted from the U/D counter 5 is also supplied to the coincidence circuit 7. When the parameter data AL1 received in the latch circuit 3*a* coincides with the counted value, namely, when the level of the envelope waveform arrives at the attack level AL, the coincidence circuit 7 generates an output coincidence signal of "1". After passing through the AND gate an4 opened by the RS flip-flop circuit r2, this output coincidence signal "1" is branched. One branch signal is supplied to the D flip-flop circuit d2 to cause it to generate an output signal of "1", thereby resetting the RS flip-flop circuit r2. Thus, the output signal of the RS flip-flop circuit r2 has a logical level of "0" to cause the U/D counter 5 to stop its counting operation. The other branch signal of the output coincidence signal "1" having passed through the AND gate an4 is supplied to an AND gate an5 and then is further branched. One branch signal of the output coincidence signal "1" having passed through the AND gate an5, which is kept open by the output signal "1" from the D flip-flop circuit d1, is supplied to the D flip-flop circuit d1. Upon receipt of this output coincidence signal "1", the D flip-flop circuit d1 generates an output signal of "0" to close the AND gate an2 and open the AND gate an3. Thus, the U/D counter 5 is designated to perform its counting-down operation. The other branch signal of the output coincidence signal "1" having passed through the AND gate an5 sets the RS flip-flop circuit r1. By this setting of the RS flip-flop circuit r1, a similar operational sequence to that occurring after the keying-on pulse signal KON is inputted is started, provided, however, that each of the address counter 2, U/D counter 5 and D flip-flop circuit d1 is not cleared. Thus, the parameter data DR1 and SL1 are latched in each of the latch circuits 3*b* and 3*a*, whereby the U/D counter 5 starts its counting-down operation from the counted value at which the U/D counter 5 is stopped. Thus, the envelope waveform producing circuit according to this embodiment generates an output signal having a waveform covering the decay section (DR), of the envelope waveform B shown in FIG. 2(*b*).

Subsequently, when the counted value of the U/D counter 5 coincides with the value of the parameter data SL1, the coincidence circuit generates an output coincidence signal of "1" and the RS flip-flop circuit r2 is reset, so that the counting-down operation of the U/D counter 5 is stopped. Although, at this time, the output coincidence signal "1" is also supplied to the AND gate an5, the RS flip-flop circuit r1 is not set because the AND gate an5 is kept closed by the output signal "0" of the D flip-flop circuit d1. Further, the U/D counter 5 is maintained to have a fixed value. Resultantly, the envelope waveform producing circuit according to this embodiment generates an output signal having a waveform covering the sustain section, of the envelope waveform B shown in FIG. 2(*b*).

Next, when, as shown in FIG. 4(*b*), the keying-off pulse signal KOF is inputted into the terminal KOF, the address counter 2 is cleared and the RS flip-flop circuit r3 is set. The output signal "1" of the RS flip-flop circuit r3 is inputted into the shift register 8*b*.

Further, upon receipt of the output signal "1" of the RS flip-flop circuit r3, the D flip-flop circuit d1 generates an output signal "0" to designate the counting-down operation. Further, by the output signal "1" of the RS flip-flop circuit r3, the shift register 8*a* is cleared and the RS flip-flop circuit r1 is reset. The RS flip-flop circuit r2 is also reset to stop the U/D counter 5 from performing its counting operation.

As the signal at the terminal Q1 of the shift register 8*b* rises, the RS flip-flop circuit r3 is reset and the latch circuit 3*a* is cleared. Simultaneously, the output terminal Q2 of the address counter 2 is set to have a signal of "1". As a result, the parameter data RR1 is read out from the parameter ROM 1. As the signal of the shift register at the terminal Q1 thereof falls, the parameter data RR1 is latched in the latch circuit 3*b*. As the signal at the terminal Q2 of the shift register 8*b* subsequently rises, the RS flip-flop circuit r2 is set, so that the counting-down operation is started. Thus, the envelope waveform producing circuit according to this embodiment produces a waveform covering the release section (RR), of the envelope waveform B shown in FIG. 2(*b*). When, thereafter, the counted value signal of the U/D counter 5 has a logical level of "0" since the latch circuit 3*a* is kept cleared, an output coincidence signal "1" is generated from the coincidence circuit 7. As a result, the RS flip-flop circuit r2 is reset, so that the counting-down operation of the U/D counter 5 is stopped.

The timing with which the keying-off pulse KOF is inputted is not limited to being chosen in the sustain section as mentioned above, but the envelope waveform producing circuit according to this embodiment may be so set that that timing is chosen in the attack section or decay section. In this case, by the above-mentioned output signal "1" of the RS flip-flop circuit r3, the above-mentioned operational sequence in the attack section or decay section is stopped, and the operational sequence in the release section is instead started. The waveform obtained in the case where the keying-off pulse signal KOF is inputted in the attack section, and that obtained in the case where that pulse signal KOF is inputted in the decay section, are shown in FIG. 5, as the alphabetic notation a and b, respectively.

The envelope waveform produced as mentioned above can be freely modified by making different parameter combinations. Examples of the envelope waveform thus obtained are shown in FIGS. 6(*a*) to 6(*f*). Since in this way the envelope waveform is defined using the sound-volume level and rise/fall time parameters, when the number of bits for each parameter data is assumed to be n, the parameter-data capacity necessary for one envelope waveform is only 5n bits. For example if the number of bits is "6" then the parameter-data capacity is 30 bits. Since in this way the data capacity necessary for one envelope waveform is small, a plurality of envelope waveforms can be stored in the parameter ROM. Further, since a desired group of parameter data is selected by the upper-order bits A3 to Ak of the address shown in FIG. 3, a plurality of groups of parameter data for each different tone color can be prepared beforehand, whereby such plurality of groups of parameter data can be selectively used for each tune or in one tune to obtain multicolor musical tones.

The envelope waveform producing circuit according to another embodiment of the present invention will now be described. In the above-mentioned embodiment, in order to obtain a natural rise (fall) of the envelope waveform, the linear increase (decrease) in counted value of the U/D counter 5 is converted into an exponential increase (decrease) by the data conversion ROM 6, the numerical data thus obtained being outputted. However, if the number of quantized bits for a sound volume is increased, the capacity of the data conversion ROM 6 would be unavoidably increased. Further, the outputted numerical data is applied, as the envelope waveform, to the waveform data read out from the waveform ROM in the multiplication circuit. As a result, problems with the scale and processing-speed of the multiplication circuit will arise. To prevent this, this second embodiment has a similar construction to that of the melody reproduction apparatus shown in FIG. 1(*a*) according to the first embodiment. However, instead of the data conversion ROM 6 inside the envelope waveform producing circuit 1*a*5 of the first embodiment and the multiplication circuit 1*a*6 and the D/A converter 1*a*7, the second embodiment is provided with a first D/A converter for making D/A conversion of the output from the U/D counter 5, an antilog amplifier circuit for exponentially converting the output from the first D/A converter and outputting the resulting exponential value, and a second D/A converter for making D/A conversion of the waveform data from the waveform ROM by using the output of the antilog amplifier circuit as a reference current, so as to obtain a similar effect to that attainable with the first embodiment by employing such a simple construction.

Figure 7:
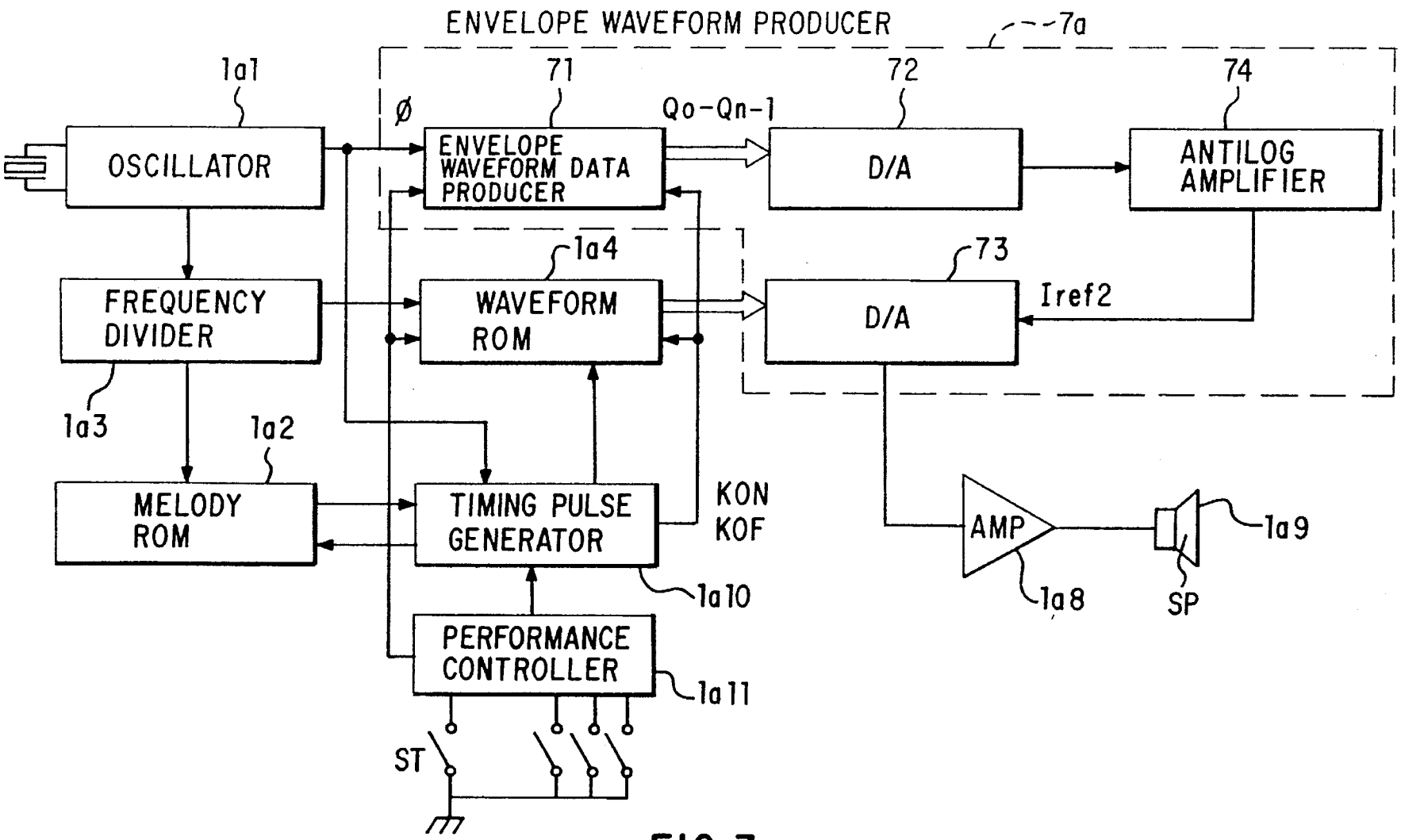
FIG. 7 is a block diagram showing the construction of the envelope waveform producing apparatus according to another embodiment of the present invention.

FIG. 7 is a block diagram showing the construction of the melody reproduction apparatus using an envelope waveform producing circuit according to this second embodiment of the present invention. In this Figure, there is provided an envelope waveform producing circuit 7*a* according to this second embodiment, which circuit is constructed of an envelope waveform data producing circuit 71, a first D/A converter 72, a second D/A converter 73, and an antilog amplifier circuit 74. In this second embodiment, the envelope data producing circuit 71 is constructed so as to cause an output signal therefrom to be generated from the U/D counter 5 by omitting the data conversion ROM 6 from the envelope waveform producing circuit according to the first embodiment, with the remaining construction and operation thereof being similar to those of the envelope waveform producing circuit according to the first embodiment. Further, the construction of the melody reproduction apparatus excluding the envelope waveform producing circuit 7*a* is the same as that of the melody reproduction apparatus using the envelope waveform producing circuit according to the first embodiment, the apparatus performing the same operations.

Figure 8:
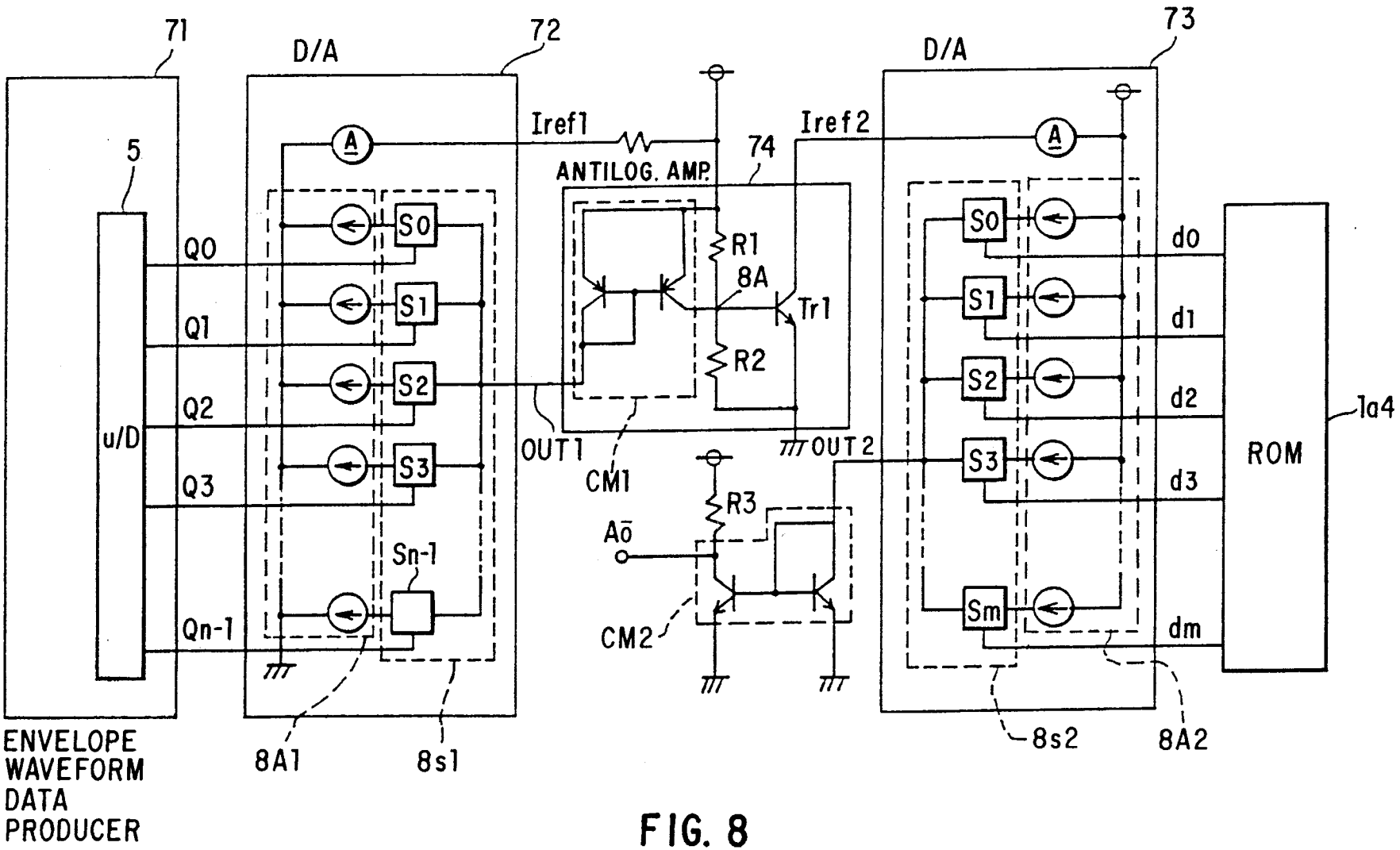
FIG. 8 is an electric-circuit diagram showing in detail an essential portion of FIG. 7.

Next, the detail of the envelope waveform producing circuit 7*a* according to this second embodiment will be described with reference to FIG. 8. As regards the envelope data producing circuit 71, only the output terminals Q0 to Qn-1 of the U/D counter 5 are shown.

The first D/A converter 72 comprises a switch circuit s1 comprised of analog switches S0 to Sn-1, each of which is opened or closed by the output signal "1" or "0" from the output terminals Q0 to Qn-1 of the U/D counter 5, respectively, and all of which are connected to output terminals OUT 1 of D/A converter 72, and a current supply circuit 8A1 for supplying current prepared by weighting a reference current $I_{refl}$ from a power source (not shown) by $k_1 2^j$, where $k_1$ is a constant and j is 0 to n-1, to each of the analog switches S0 to Sn-1. Further, the current from the output terminal OUT1 is supplied to the antilog amplifier circuit 74.

The antilog amplifier 74 comprises a current mirror circuit CM1 for preventing the fluctuation in voltage of the output signal from the D/A converter, a transistor Tr1 having a base receiving the output signal from the current mirror circuit CM1 and outputting a current $I_c$ flowing in its collector as a reference current $I_{ref2}$ for the second D/A converter 73, a resistor R1 for applying a suitable bias voltage to the base of the transistor Tr1, and a resistor R2 connected between the base and emitter of the transistor Tr1 for converting the variation in level of the output signal from the current mirror circuit CM1, i.e., the variation in level of the output signal from the first D/A converter 72, into a variation in level of the voltage $V_{BE}$ across the base and emitter of the transistor Tr1.

Incidentally, a temperature compensation circuit may be provided for the purpose of avoiding the variations in the $V_{BE}$-$I_C$ characteristic due to the variation in temperature of the transistor Tr1.

The second D/A converter 73 comprises a switch circuit 8s2 comprised of analog switches S0 to Sm, each of which is opened or closed by the output signal "1" or "0" from the data output terminals d0 to dm of the waveform ROM 1a4, respectively, and all of which are connected to an output terminal OUT2 of D/A converter 73. The second D/A converter 73 also includes a current supply circuit 8A2 for supplying a current prepared by weighting a reference current $I_{ref2}$ by $k_2 2^j$, where $k_2$ is a constant, and j is 0 to m, to each of the analog switches S0 to Sm, thereby generating an output waveform signal from the output terminal OUT2. Further, the output signal generated from the output terminal OUT2 is passed through a current mirror circuit CM2 for preventing fluctuation in its voltage, and then the variation in level thereof is converted by a resistor R3 into a variation in voltage level, the resulting voltage signal being outputted to the amplifier 1a8.

The operation of the envelope waveform producing circuit 7a according to this second embodiment will now be described.

The envelope waveform data producing circuit 71 operates in a similar manner to the envelope waveform data producing circuit according to the first embodiment, in which a counted value signal is outputted from the output terminals Q0 to Qn−1 of the U/D counter 5. The output signal "1" or "0" from the output terminals Q0 to Qn−1 opens or closes the analog which switches S0 to Sn−1 of the first D/A converter 72. The analog switches S0 to Sn−1 are supplied with the current obtained from the reference current $I_{ref1}$ weighted by $k_1 2^j$ so that the counted value is converted into a current $I_{OUT}$ from digital to analog basis, which current is outputted into the antilog amplifier 74 via the output terminal OUT1. This current $I_{OUT}$ linearly varies as the counted value increases or decreases.

In the antilog amplifier circuit 74 which has received the current $I_{OUT}$ momentarily varying with variations in the counted value, the current $I_{OUT}$ appears at a terminal 8A after passing through the current mirror circuit CM1. This variation in level of the current $I_{OUT}$ is converted by the resistor R2 into a variation in level of the voltage $V_{BE}$ across the base and emitter of the transistor Tr1. At this time, since the current $I_C$ flowing into the collector of the transistor Tr1 flows in accordance with the $V_{BE}$-$I_C$ characteristic, the linear variation in the current $I_{OUT}$ outputted from the first D/A converter 72 is converted into an exponential variation in the current $I_C$. For example, assume now that the coefficient determined depending upon the hfe and saturation current of the transistor Tr1 is represented by a, the amount of change in the current $I_{OUT}$ is represented by $\Delta I_{OUT}$, and the input impedance of the transistor Tr1 is somewhat greater than the resistance value r of the resistor R2. Then, the amount of change $\Delta I_C$ in the current $I_C$ is determined depending substantially upon the equation $\Delta I_C$=a EXP (q.r. $\Delta I_{OUT}$/KT). This current $I_C$ is outputted as the reference current $I_{ref2}$ for the second D/A converter 7 3.

In the second D/A converter 73, upon receipt of the output signal "1" or "0" from the data output terminals d0 to dm of the waveform ROM 1a4, the analog switches S0 to Sm are opened or closed. The analog switches S0 to Sm are supplied with the current obtained from the reference current $I_{ref2}$ weighted by $k_2 2^j$, respectively, whereby the output data from the waveform ROM 1a4 is converted into a current $I_{OUT2}$ from digital to analog basis. At this time, since the reference current $I_{ref2}$ is one which has been prepared through the above-mentioned converting of the counted value outputted from the envelope waveform producing circuit into an exponentially varying current value by the first D/A converter 72 and the antilog amplifier circuit 74, the waveform data outputted from the waveform ROM 1a4 is applied with the envelope waveform defined by the above-mentioned parameters and then is subjected to D/A conversion. This current $I_{OUT2}$ is outputted into the current mirror circuit CM2. A current equal in level to the current $I_{OUT2}$ appears at an output terminal of the current mirror circuit CM2 and the variation in this current is converted into a variation in voltage by the resistor R3 to be outputted into the amplifier 1a8.

As described above, in this second embodiment, the counted value of the U/D converter 5 is first converted in an analog manner and then an envelope waveform is obtained therefrom by using the $V_{BE}$- $I_C$ characteristic of the transistor Tr1. Therefore, this second embodiment has a simple construction as compared with the above-mentioned first embodiment using the data conversion ROM 6. Further, since the waveform data is applied, in an analog manner, with the envelope waveform data, the data-producing can be performed at a higher speed than in the case of using the multiplication circuit in which data-processing is digitally performed.

Next, the envelope waveform producing circuit according to still another embodiment of the present invention will be described. In each of the above-mentioned embodiments, the frequency of the clock pulse signal is determined in accordance with one parameter for defining the rise or fall rate of the envelope waveform in one of the attack, decay, and release sections thereof. This pulse signal is counted in the U/D counter and the linear variation with time of this counted value outputted therefrom is converted into an exponential variation by the data conversion ROM 6 or antilog amplifier circuit 74 to obtain an envelope waveform. In contrast, in this third embodiment, each of the attack, decay, and release sections is further divided into narrower sections, and a plurality of parameters are stored for defining the rise or fall rate in one of the attack, decay, and release sections. The straight lines defined by the individual parameters are combined with each other so as to obtain an approximation curvilinear waveform for each section.

Figure 9:
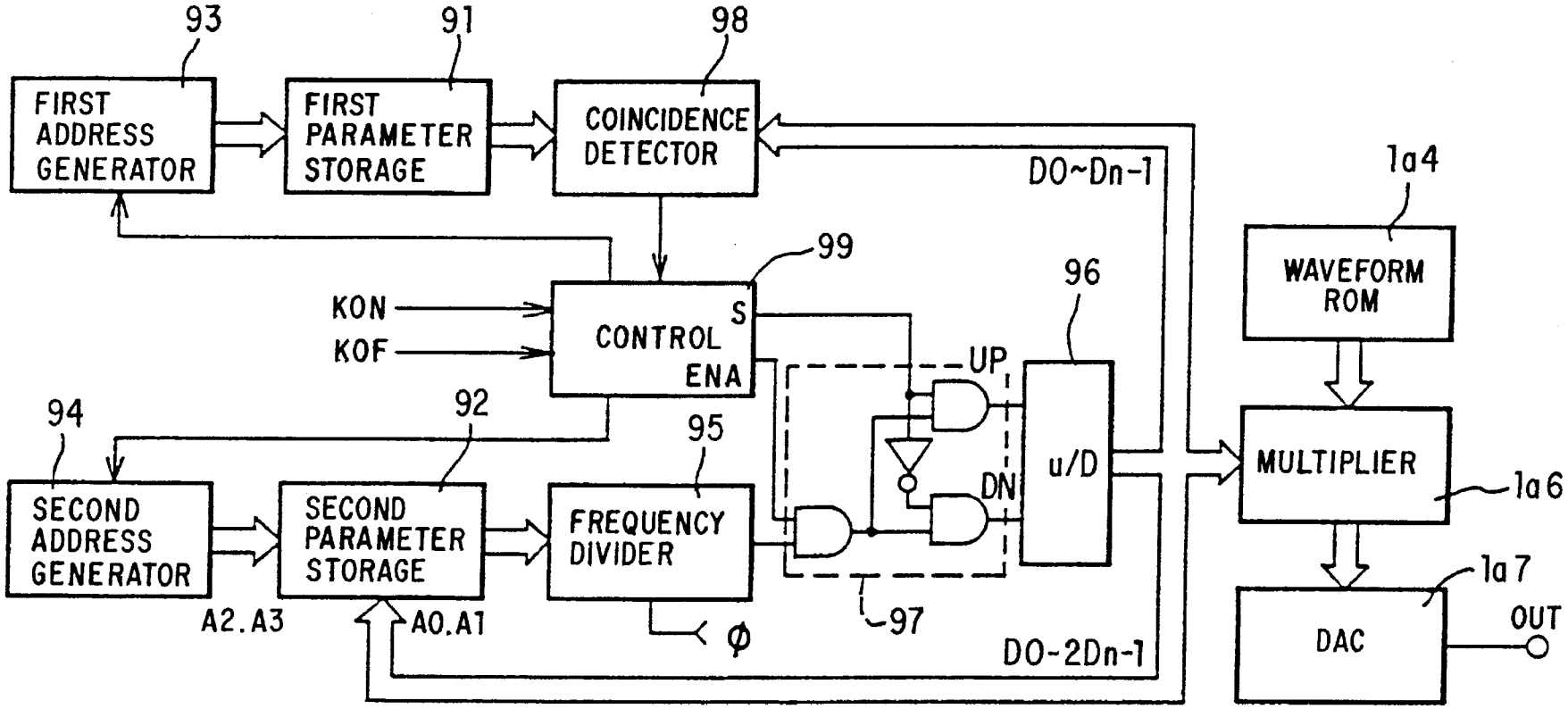
FIG. 9 is a logic-circuit diagram showing the construction of the envelope waveform producing apparatus according to a third embodiment of the present invention.

FIG. 9 is a block diagram showing the construction of the envelope waveform producing circuit according to this third embodiment of the present invention. Specifically, there are provided a first parameter storage device 91 and a second parameter storage device 92, respectively, each of which is comprised of a memory which is preferably a ROM, but which may be a RAM or the like. The first parameter storage device 91 is stored therein with parameters AL and SL for determining the attack level and the sustain level, respectively, while, on the other hand, the second parameter storage device 92 is stored therein with parameters for defining the rise rate and the fall rate of the envelope waveform. As regards these parameters, the address of each parameter thereof is varied, as later described, in accordance with the variation in data of the upper-order m bits (m is an integer) of the U/D converter. Thus, each of the attack, decay, and release sections is further divided into a plurality of sections. The parameters for defining the rise rates and the fall rates of the envelope waveform, each of which varies from one section of such plurality of sections to another, are stored in the second parameter storage device 92. Assume now that m is, for example, 2 (m is defined to be not greater than 2). Then, as shown in FIG. 10(*a*), the rise rate of the envelope waveform is defined by the parameters, each of which is different in each corresponding one of four sections (i=1 to 4). Further, as shown in FIG. 10(*b*), in the addresses  0000 to  1011 of the second storage device 92 there are sequentially stored parameters AR1 to AR4 for defining the rise rates in the attack section, parameters DR1 to DR4 for defining the fall rates in the decay section, and parameters RR1 to RR4 for defining the fall rates in the release section.

Turning back to FIG. 9, the envelope waveform producing circuit further includes a first address generation circuit 93 and a second address generation circuit 94. The first address generation circuit 93 designates the address of one parameter in the first parameter storage device 91 and the second address generation circuit 94 designates the address of one parameter in the second parameter storage device 92.

There is further provided a 1/N frequency divider circuit 95. When the value of the parameter from the second parameter storage device 92 is assumed to be N, the frequency divider 95 divides the frequency of the reference clock pulse signal from the oscillator (not shown) by N into a 1/N frequency signal, which in turn is outputted therefrom as a clock pulse signal.

A U/D counter 96 and a selector circuit 97 are also provided. The selector circuit 97 receives a signal "1" from a terminal ENA and, in response to the signal "1" and "0" from a terminal S, outputs the clock pulse signals which are inputted from the 1/N frequency divider circuit 95 to a count-up terminal UP and a count-down terminal DN of the U/D counter 96, respectively.

The U/D counter 96 counts the clock pulse signal from the selector circuit 97 to generate an output counted value signal. This output counted value is inputted into the above-mentioned multiplication circuit 1*a*6 as an envelope waveform, where it is multiplied by the waveform outputted from the waveform ROM 1*a*4. Further, the data lines of the upper-order two bits of the U/D counter 96 are connected to the address lines A0 and A1 of the second parameter storage device 92.

A coincidence detection circuit 98 detects coincidence of the counted value from the U/D counter 96 with the value of the parameter AL, SL outputted from the first parameter storage circuit 91 to generate an output coincidence signal. A control circuit 99 which is comprised of a CPU, a RAM, a ROM, etc. receives a keying-on pulse signal KON, a keying-off pulse signal KOF, and an output coincidence signal from coincidence detection circuit 98 so as to control the operation of the entire envelope waveform producing circuit according to this third embodiment of the present invention.

The operation of the envelope waveform producing circuit device according to this embodiment will now be described. First, the operation thereof connected with the attack section will be discussed. Upon receipt of the keying-on pulse signal KON, the control circuit 99 enables the first and the second address generation circuits 93 and 94 to operate, whereupon the parameter AL for defining the attack level is outputted from the first parameter storage device 91. Further, by the output signal from the second address generation circuit 94, the values of the address lines A3 and A2 of the second parameter storage device 92 are designated as being "00". Since the address lines A0 and A1 have a value of "0" (note here that the counted value of the U/D counter 96 is "0"), the address " 0000" is designated, whereby the parameter AR1 for defining the rise rate in the first section (the section between i=0 and i=1) in the attack section is read out. The 1/N frequency divider circuit 95 which has received the parameter AR1 divides the frequency of the reference clock pulse signal from the oscillator (not shown) by a number N of frequency divisions corresponding to the value of the parameter AR1 to generate the resulting 1/N frequency signal as a clock pulse signal. On the other hand, the selector 97 receives an output signal "1" from each of the terminals ENA and S, which causes the selector 97 to output the clock pulse signals which are inputted from the 1/N frequency divider circuit 95 to the terminal UP of the U/D counter 96. As a result, the U/D counter 96 starts its counting-up of the clock pulse signal from the 1/N frequency divider 95**.

At this time, as the upper-order two bits of the U/D counter 96 vary from "00" to "11", the values of the address lines A0 and A1 of the second parameter storage device 92 also vary and the parameter also varies from AR1 to AR4 sequentially. The number of frequency divisions in the 1/N frequency divider circuit 95 also varies accordingly. By setting the value N of the parameters AR1 to AR4 to a suitable value at this time, the variation in counted value of the U/D counter 96 indicates a curvilinear style of exponential increase approximated by connected straight lines. For example, assume now that a curve y shown in FIG. 10(*a*) is represented by the function of a time t: y=EXP (kt)−1. Assume also that the time at which each section starts is represented by ti (i=0, 1, - - - $2^m$ 1, where m=2) as shown in FIG. 10(*a*), the number of bits of the U/D counter 96 is represented by n, k represents a suitable constant, and $\phi$ represents the frequency of the reference clock pulse signal. Then, the value N of the parameter ARi+1 is expressed by the equation shown in FIG. 10(*c*).

As mentioned above, the envelope waveform in the attack section is obtained from the counted value of the U/D counter 96.

When the counted value of the U/D counter 96 coincides with the value of the parameter AL outputted from the first parameter storage device 91, the attack section ends and an output coincidence signal is generated from the coincidence detection circuit 98. Upon receipt of it, the control circuit 99 supplies a signal "0" to the terminal ENA of the selector circuit 97 to stop the counting operation of the U/D counter 96. Simultaneously, the control circuit 99 generates an output control signal to the first address generation circuit 93 and to the second address generation circuit 94. The first address generation circuit 93 designates one address of the first parameter storage device 91, so that the parameter SL is outputted therefrom. Further, the second address generation circuit 94 designates the values "01" of the address lines A2 and A3 of the second parameter storage device 92, so that the parameters DR1 to DR4 are outputted. Note that the parameters DR1 to DR4 are designated by the upper-order two bits of the value of the parameter data AL. If, for example, the upper order two bits are "01", then the parameter data DR2 will be outputted. Simultaneously, the control circuit 99 supplies an output signal "1" to the terminal ENA of the selector circuit 97 and an output signal "0" to the terminal S thereof so as to switch the counting-up operation of the U/D counter 96 to the counting-down operation thereof and cause this counter 96 to start this counting-down operation, whereby the decay section begins. In this case as well, the parameters DR1 to DR4 are selected in accordance with the variation in value of the upper-order two bits of the U/D counter 96 resulting from the counting-down operation. The number of frequency divisions in the 1/N frequency divider circuit 95 is also varied accordingly. Thus, the variation in counted value of the U/D counter 96 indicates a style of exponential decay approximated by connected straight lines, as in the case of the above-mentioned attack section, thus obtaining an envelope waveform in the decay section.

Further, when the counted value from the U/D counter 96 coincides with the value of the parameter SL, the coincidence detection circuit 98 generates an output coincidence signal. Upon receipt of it, the control circuit 99 supplies an output control signal "0" to the terminal ENA of the selector circuit 97 to stop the counting operation of the U/D counter 96. Thus, the sustain section begins.

Next, when receiving the keying-off pulse KOF, the control circuit 99 generates an output control signal to the first address generation circuit 93 and to the second address generation circuit 94. Thus, the first address generation circuit 93 is reset, so that the value of the output signal from the first parameter storage device 92 becomes "0". Thus, the coincidence detection circuit 98 generates an output coincidence signal in response to the counted value "0" from the U/D counter 96. Further, the second address generation circuit 94 designates the values "10" of the address lines A3 and A2 of the second parameter storage device 92, so that the parameters RR1 to RR4 are outputted. Note that the parameters RR1 to RR4 are determined by the upper-order two bits of the parameter SL as in the case of the parameters DR1 to DR4. On the other hand, the control circuit 99 supplies an output control signal "1" to the terminal ENA of the selector circuit 97 to cause the U/D counter 96 to start its counting-down operation. In accordance with the variation in value of the upper-order two bits of the U/D counter 96 resulting from that counting-down operation, the parameters RR1 to RR4 are varied as mentioned above. Thus, the variation in counted value of the U/D counter 96 indicates a style of exponential decay approximated by connected straight lines, thus obtaining an envelope waveform in the release section.

Subsequently, when the counted value of the U/D counter 96 coincides with "0", an output coincidence signal is generated from the coincidence detection circuit 98 and the control circuit 99 supplies an output control signal "0" to the terminal ENA of the selector circuit 97. Thus, the U/D counter 96 stops its counting operation. Thus, the envelope waveform producing operation is terminated.

Although in this third embodiment the production of one envelope waveform from one group of parameters has been described for convenience of explanation, the invention is not limited thereto but permits a plurality of groups of parameters to be provided so as to produce a suitable one or one of a plurality of possible envelope waveforms. For example, other groups of parameters are stored in the second parameter storage device 92, as they may be located in another portion not shown in FIG. 10(*b*) showing the contents of the second parameter storage device 92. Thereby, the desired group of parameters is designated by the address lines A4 and A5 (not shown in FIG. 9). Another group of parameters corresponding to such other group of parameters is additionally stored in the first parameter storage device 91.

Figure 11:
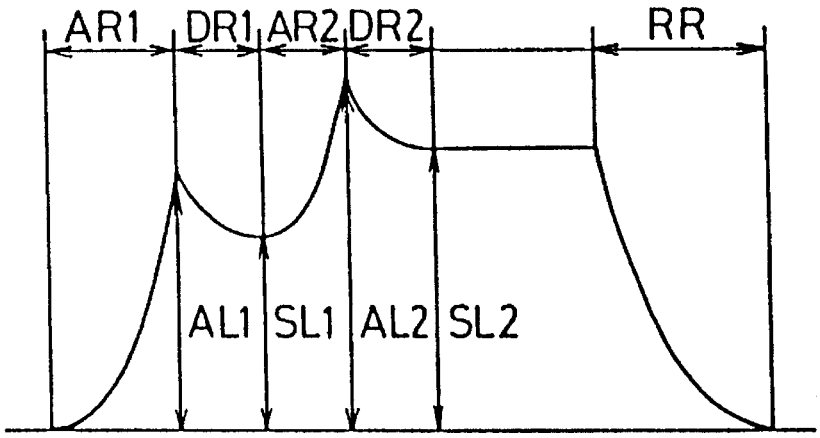
FIG. 11 is a waveform diagram for explaining a modification of the third embodiment.
Figure 12A:
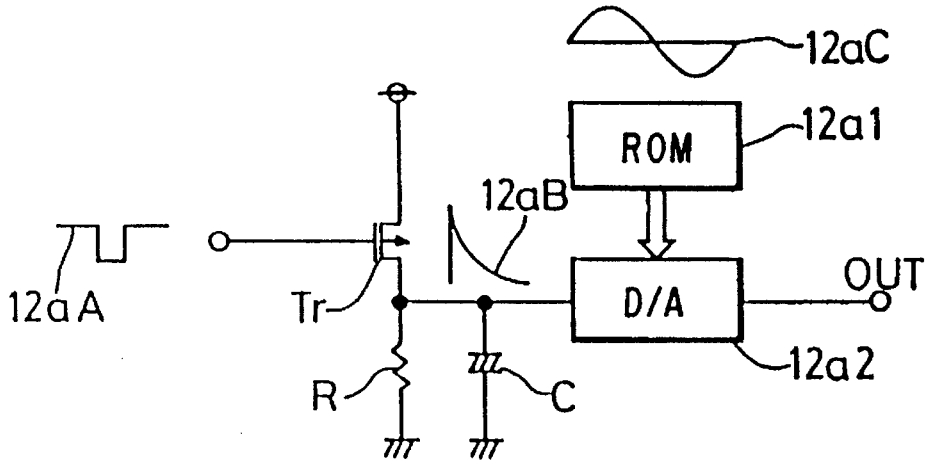
FIG. 12(a) PRIOR ART
FIGS. 12(*a*) and 12(*b*) are circuit/block diagrams showing the construction of conventional envelope waveform producing apparatus.
Figure 12B:
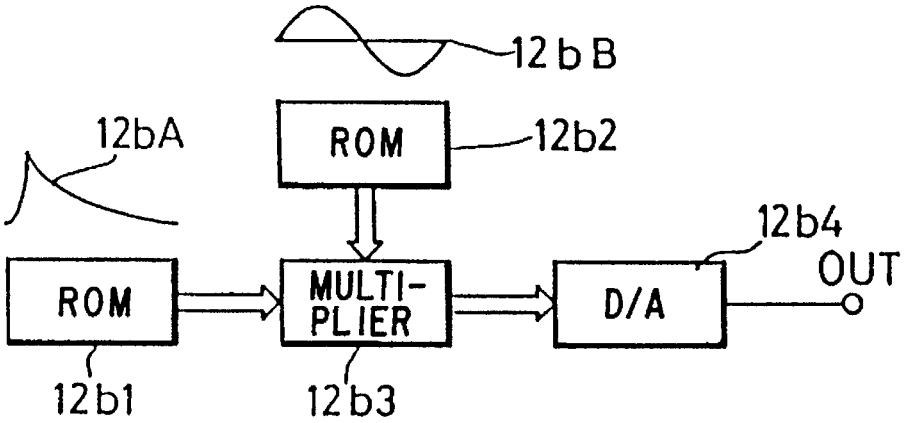
FIG. 12(b) PRIOR ART

Further, the invention is not limited to one attack level and one sustain level. For example, a second attack level and a second sustain level may be provided as shown in FIG. 11, and a second attack rate and a second decay rate are correspondingly provided. By increasing the kinds of parameters in this way, it is possible to produce a more complicated envelope waveform.

Further, by not providing one rise or fall defining parameter with respect to each counted-value range of the U/D counter 96, but by computing the upper-order M-bit data and one rise or fall defining parameter data, the number N of frequency divisions in the 1/N frequency divider circuit 95 may be also obtained.

Further, in each of the above-mentioned embodiments, as the respective envelope waveform, the parameters defining the rise or fall rate in each section of the envelope waveform, and the parameters defining the wave height, such as the attack level or the sustain level, are stored in a ROM or the like. Thereby, these parameters are read out to produce an envelope waveform.

However, one of the former parameters and the latter parameters may be set to be fixed values, so that it is only necessary to store the other parameters in a plurality of groups in a storage device, these parameters being read out to produce an envelope waveform.

Thus, according to the present invention, a complicated envelope waveform can be easily obtained with a small scale of circuit construction.

What is claimed is:

1. An envelope waveform producing circuit comprising:

storage means for storing a plurality of groups of parameter data, each group of parameter data defining a waveform of an envelope which includes data representing an attack rate, an attack level, a decay rate, a sustain level and a release rate, address designation means for reading out a desired group of parameter data from said storage means, frequency divider means for dividing a frequency of a reference clock pulse into a plurality of frequency-divided signals, selector means for selecting a frequency-divided signal from the frequency divider means in accordance with the parameter data representing the attack rate, decay rate, or release rate read out from the storage means, UP/DOWN counter means for selectively counting up or down from a preset value by a frequency of the frequency-divided signal selected by the selector means, coincidence detector means for detecting coincidence between a counted value of said UP/DOWN counter means and a predetermined value determined by the parameter data representing attack level or sustain level read out from the storage means, control means for controlling said address designation means to read out desired parameter data and for controlling said UP/DOWN counter means to count up or down from said preset value, and activation or deactivation of said UP/DOWN counter means in response to a detection of the coincidence detector means, and data conversion storage means for converting a variation value of the counted value of said UP/DOWN counter means to an exponential variation value.

2. An envelope waveform producing circuit comprising:

storage means for storing a plurality of groups of parameter data, each group of parameter data defining a waveform of an envelope which includes data representing at least one of an attack rate and an attack level and data representing at least one of a decay rate and a sustain level;

address designation means, connected with said storage means, for reading out a desired group of parameter data from said storage means to cause an envelope waveform to be produced in accordance with said parameter data read out;

UP/DOWN counter means for selectively counting up and down from a preset value;

coincidence detector means, connected with said UP/DOWN counter means, for detecting coincidence between a counted value of said UP/DOWN counter means and a predetermined value;

control means, connected with said UP/DOWN counter means and said address designation means, for controlling said address designation means to read out desired parameter data and for controlling said UP/DOWN counter means to count up or down from said preset value, and activation or deactivation of said UP/DOWN counter means;

first digital to analog conversion means, connected with said UP/DOWN counter means, for converting the counted value of said UP/DOWN counter means to an analog value;

antilog amplifier means, connected with said first digital to analog conversion means, for producing a reference current in response to an output from said first digital to analog conversion means;

second digital to analog conversion means, connected with said antilog conversion means, for converting digital waveform data from a waveform storage device, to an analog output in accordance with said reference current.

3. An envelope waveform producing circuit according to claim 2, wherein said first digital to analog conversion means includes a plurality of switches connected with said UP/DOWN counter means and individually actuated in accordance with the counted value of said UP/DOWN counter means to supply said analog value to said antilog amplifier means.

4. An envelope waveform producing circuit according to claim 3, wherein said first digital to analog conversion means further includes weighting means for weighting a current from a reference source by a factor $k_1 2^j$ wherein $k_1$ is a constant, j varies from 0 to n−1 and n is the number of switches.

5. An envelope waveform producing circuit according to claim 2, wherein said second digital to analog conversion means includes a plurality of switches connected with said waveform storage device and said antilog conversion means, and individually actuated in accordance with the digital waveform data of said waveform storage device to produce said analog output.

6. An envelope waveform producing circuit according to claim 5, wherein said second digital to analog conversion means further includes weighting means for weighting the reference current from said antilog amplifier means by a factor $k_2 2^j$ wherein $k_2$ is a constant, j varies from 0 to n−1 and n is the number of switches.

7. An envelope waveform producing circuit according to claim 2, wherein said antilog amplifier means includes a current mirror circuit connected with said first digital to analog conversion means.

8. An envelope waveform producing circuit according to claim 2, further including output circuit means, connected with said second digital to analog conversion means, for converting a variation in level of the analog output from said second digital to analog conversion means to a variation in voltage level.

9. An envelope waveform producing circuit comprising:

storage means for storing a plurality of groups of parameter data, each group of parameter data defining a waveform of an envelope which includes data representing at least one of an attack rate and an attack level and data representing at least one of a decay rate and a sustain level, said storage means including:

first parameter storage means for storing parameter data representing the attack level and the sustain level, and second parameter storage means for storing parameter data representing the attack rate and the decay rate;

address designation means, connected with said storage means, for reading out a desired group of parameter data from said storage means to cause an envelope waveform to be produced in accordance with said parameter data read out;

UP/DOWN counter means for selectively counting up and down from a preset value;

coincidence detector means, connected with said UP/DOWN counter means, for detecting coincidence between a counted value of said UP/DOWN counter means and a predetermined value;

control means, connected with said UP/DOWN counter means and said address designation means, for controlling said address designation means to read out desired parameter data and for controlling said UP/DOWN counter means to count up or down from said preset value, and activation or deactivation of said UP/DOWN counter means;

1/N frequency divider means, connected with said second parameter storage means, for dividing a frequency of a reference clock pulse in accordance with parameter data read out of said second parameter storage means, to produce a divided clock pulse signal; and selector means, connected with said 1/N frequency divider means, said control means and said UP/DOWN counter means, for controlling up and down counting by said UP/DOWN counter means in response to said control means.

10. An envelope waveform producing circuit comprising:

storage means for storing a plurality of groups of parameter data, each group of parameter data defining a waveform of an envelope which includes data representing at least one of an attack rate and an attack level and data representing at least one of a decay rate and a sustain level, address designation means, connected with said storage means, for reading out a desired group of parameter data from said storage means to cause an envelope waveform to be produced in accordance with said parameter data read out, latch means for time-divisionally latching selected parameters from said storage means as a preset value, UP/DOWN counter means for selectively counting up and down from said preset value, coincidence detector means, connected with said UP/DOWN counter means, for detecting coincidence between a counted value of said UP/DOWN counter means and a predetermined value, control means, connected with said UP/DOWN counter means and said address designation means, for controlling said address designation means to read out desired parameter data and for controlling said UP/DOWN counter means to count up or down from said preset value, and activation or deactivation of said UP/DOWN counter means, and data conversion storage means, connected with said UP/DOWN counter means, for converting a variation value of the counted value of said UP/DOWN counter means to an exponential variation value.

11. An envelope waveform producing circuit comprising:

storage means for storing a plurality of groups of parameter data, each group of parameter data defining a waveform of an envelope which includes data representing at least one of an attack rate and an attack level and data representing at least one of a decay rate and a sustain level, address designation means, connected with said storage means, for reading out a desired group of parameter data from said storage means to cause an envelope waveform to be produced in accordance with said parameter data read out, UP/DOWN counter means for selectively counting up and down from said preset value, coincidence detector means, connected with said UP/DOWN counter means, for detecting coincidence between a counted value of said UP/DOWN counter means and a predetermined value, control means, connected with said UP/DOWN counter means and said address designation means, for controlling said address designation means to read out desired parameter data and for controlling said UP/DOWN counter means to count up or down from said preset value, and activation or deactivation of said UP/DOWN counter means, first digital to analog conversion means, connected with said UP/DOWN counter means, for converting the counted value of said UP/DOWN counter means to an analog value, antilog amplifier means, connected with said first digital to analog conversion means, for producing a reference current in response to an output from said first digital to analog conversion means, second digital to analog conversion means, connected with said antilog conversion means, for converting digital waveform data from a waveform storage device, to an analog output in accordance with said reference current, said first digital to analog conversion means including a plurality of switches connected with said UP/DOWN counter means and individually actuated in accordance with the counted value of said UP/DOWN counter means to supply said analog value to said antilog amplifier means, and said second digital to analog conversion means includes a plurality of switches connected with said waveform storage device and said antilog conversion means, and individually actuated in accordance with the digital waveform data of said waveform storage device to produce said analog output.

12. An envelope waveform producing circuit according to claim 11, wherein said first digital to analog conversion means further includes weighting means for weighting a current from a reference source by a factor $k_1 2^j$ wherein $k_1$ is a constant, j varies from 0 to n−1 and n is the number of switches.

13. An envelope waveform producing circuit according to claim 11, wherein said second digital to analog conversion means further includes weighting means for weighting the reference current from said antilog amplifier means by a factor $k_2 2^j$ wherein $k_2$ is a constant, j varies from 0 to n−1 and n is the number of switches.

14. An envelope waveform producing circuit according to claim 11, wherein said antilog amplifier means includes a current mirror circuit connected with said first digital to analog conversion means.

15. An envelope waveform producing circuit according to claim 11, further including output circuit means, connected with said second digital to analog conversion means, for converting a variation in level of the analog output from said second digital to analog conversion means to a variation in voltage level.

16. An envelope waveform producing circuit comprising:

storage means for storing a plurality of groups of parameter data, each group of parameter data defining a waveform of an envelope which includes data representing at least one of an attack rate and an attack level and data representing at least one of a decay rate and a sustain level, said storage means including:

first parameter storage means for storing parameter data representing the attack level and the sustain level, and second parameter storage means for storing parameter data representing the attack rate and the decay rate, address designation means, connected with said storage means, for reading out a desired group of parameter data from said storage means to cause an envelope waveform to be produced in accordance with said parameter data read out, said address designation means including:

first address generation means for designating an address of one parameter data stored in said first parameter storage means, and second address generation means for designating an address of one parameter data stored in said second parameter storage means, UP/DOWN counter means for selectively counting up and down from said preset value, coincidence detector means, connected with said UP/DOWN counter means, for detecting coincidence between a counted value of said UP/DOWN counter means and a predetermined value, control means, connected with said UP/DOWN counter means and said address designation means, for controlling said address designation means to read out desired parameter data and for controlling said UP/DOWN counter means to count up or down from said preset value, and activation or deactivation of said UP/DOWN counter means, 1/N frequency divider means, connected with said second parameter storage means, for dividing a frequency of a reference clock pulse in accordance with parameter data read out of said second parameter storage means, to produce a divided clock pulse signal, and selector means, connected with said 1/N frequency divider means, said control means and said UP/DOWN counter means, for controlling up and down counting by said UP/DOWN counter means in response to said control means.

* * * * *